US008532522B2

(12) United States Patent
Kawamura et al.

(10) Patent No.: US 8,532,522 B2
(45) Date of Patent: Sep. 10, 2013

(54) TONER CARTRIDGE

(75) Inventors: Yoshihide Kawamura, Shizuoka (JP); Masashi Hasegawa, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 405 days.

(21) Appl. No.: 12/922,789

(22) PCT Filed: Mar. 16, 2009

(86) PCT No.: PCT/JP2009/055562

§ 371 (c)(1),
(2), (4) Date: Sep. 15, 2010

(87) PCT Pub. No.: WO2009/116655

PCT Pub. Date: Sep. 24, 2009

(65) Prior Publication Data

US 2011/0038647 A1 Feb. 17, 2011

(30) Foreign Application Priority Data

Mar. 17, 2008 (JP) ..... 2008-068234

(51) Int. Cl.
*G03G 15/08* (2006.01)

(52) U.S. Cl.
USPC ..... 399/102; 399/106; 222/DIG. 1

(58) Field of Classification Search
USPC ..... 399/102, 106, 262; 222/DIG. 1
See application file for complete search history.

(56) References Cited

U.S. PATENT DOCUMENTS

| | | | | |
|---|---|---|---|---|
| 6,104,900 | A * | 8/2000 | Ishikawa et al. | 399/262 |
| 6,298,208 | B1 * | 10/2001 | Kawamura et al. | 399/262 |
| 2008/0240771 | A1 | 10/2008 | Kurita et al. | |
| 2009/0279916 | A1 * | 11/2009 | Naito et al. | 399/262 |

FOREIGN PATENT DOCUMENTS

| | | |
|---|---|---|
| CN | 1264855 | 8/2000 |
| EP | 1022620 | 7/2000 |
| JP | 2000-214669 | 8/2000 |
| JP | 2001-201926 | 7/2001 |
| JP | 3628539 | 12/2004 |
| JP | 2006-208574 | 8/2006 |
| JP | 2008-9228 | 1/2008 |

OTHER PUBLICATIONS

Apr. 26, 2012 Chinese office action (including English translation thereof) in connection with a corresponding Chinese patent application.

International Search Report and Written Opinion in PCT/JP2009/055562.

European search report dated Oct. 24, 2012 in connection with corresponding European patent application No. 09723148.4.

* cited by examiner

*Primary Examiner* — David Gray
*Assistant Examiner* — Laura Roth
(74) *Attorney, Agent, or Firm* — Cooper & Dunham LLP

(57) ABSTRACT

A toner cartridge contains a toner container including an opening and configured to contain a toner. An engaging member includes a ring-shaped seal member disposed on a seal member installation surface. The engaging member is engaged with the toner container to cover the opening and rotatably mounted to the toner container while an edge of the opening is frictionally slid on a surface of the seal member. The toner container is configured to convey the toner into the engage member through the opening and discharge the toner therefrom as the toner container is rotated. The seal member includes a non-contact portion at a surface thereof facing the installation surface and being free from any contact with the installation surface so that the engage member includes a space extending from the surface of the seal member where the edge of the opening is frictionally slid to the non-contact portion.

7 Claims, 9 Drawing Sheets

TONER CARTRIDGE

TECHNICAL FIELD

The present invention relates to a toner cartridge for supplying toner to a developing section in an image forming apparatus such as a printer, a facsimile, and a copying machine.

BACKGROUND ART

There has widely been used an image forming apparatus, such as a copying machine, a facsimile, and a printer, that uses an electrophotographic system to form an electrostatic latent image on a photoconductive member, develop the electrostatic latent image using a toner which is a developer, and transfer an obtained toner image onto a transfer sheet. In order to enable continuous image forming operation, the image forming apparatus of this type has a mechanism in which a toner is supplied to a developing section in such a manner as to prevent the developing section to run out of the toner.

As a method that supplies a toner to the developing section of an image forming apparatus, there is known the method in which a toner supply container containing a toner in the main body thereof is provided in the image forming apparatus, and the container main body is rotated to convey the toner outside through a toner supply port of the container main body.

The toner supply container disclosed in Patent Literature 1 is constituted by a cylindrical container body containing a toner therein and a toner discharge unit having a toner discharge port for discharging the toner contained in the container main body outside the toner supply container. An opening having a diameter smaller than the diameter of the container main body is formed in one end surface of the container main body, and the container main body and toner discharge unit are engaged with each other at an engagement portion in a state where the edge of the opening and a seal member provided in a seal member installation portion in the toner discharge unit contact each other. The container body has a spiral groove on the inner peripheral surface thereof. When the toner supply container is attached to the image forming apparatus substantially horizontally, and the container main body is rotated in a predetermined direction about the axis line thereof in a frictional sliding manner with respect to the seal member, the toner contained in the container main body is sequentially migrated toward the opening side by means of the spiral groove to be fed into the opening. The toner that has reached the opening is pushed out from the opening into the toner discharge unit and then discharged outside through the toner discharge port of the toner discharge unit.

When the toner in the container main body is consumed and used up after the repetition of an image forming process, the empty toner supply container is removed from the image forming apparatus, and another toner supply container having a container main body filled with a toner is attached to the image forming apparatus. In terms of effective use of resources, the removed toner supply container is preferably reused.

In the case where the toner supply container is reused, the seal member, which is deteriorated or deformed with age, is preferably replaced with new one so as to ensure sealing performance. However, in the existing toner supply container, the seal member is brought into close contact with the seal member installation surface of the seal member installation portion or inner wall of the toner supply container, making it difficult to pinch the seal member when the seal member is removed from the seal member installation surface. Thus, it takes time and effort to remove the seal member from the seal member installation surface.

In order to make it easier to remove the seal member from the seal member installation portion, a method can be considered in which a portion around the seal member installation portion is constituted by a plurality of parts so as to be disassembled. However, the number of parts is increased to increase the cost of the toner supply container.

[Patent Literature 1] Japanese Patent (JP-B) No. 3628539

DISCLOSURE OF INVENTION

The present invention has been made in view of the above problems, and an object thereof is to provide a toner cartridge capable of being easily remove a seal member from a surface of a seal member installation without increasing a cost.

Means for solving the above problems are as follow:

<1> A toner cartridge containing: a toner container formed with an opening, and configured to contain a toner therein; and an engaging member containing a ring-shaped seal member disposed on a seal member installation surface provided in the engaging member, the engaging member being engaged with the toner container so as to cover the opening of the toner container and rotatably mounted to the toner container while an edge of the opening of the toner container is frictionally slid on a surface of the ring-shaped member, wherein the toner container is configured to convey the toner contained therein into the engage member through the opening and discharge the toner from the engage member, as the toner container is rotated, and wherein the seal member includes a non-contact portion arranged at a surface thereof which faces the seal member installation surface, the non-contact portion being free from any contact with the seal member installation surface, so that the engage member includes a space extending from the surface of the seal member on which the edge of the opening is frictionally slid to the non-contact portion in the engaging member.

<2> The toner cartridge according to <1>, wherein the non-contact portion exists on an outer circumferential side of the ring-shaped seal member.

<3> The toner cartridge according to <1>, wherein the non-contact portion exists on an inner circumferential side of the ring-shaped seal member.

<4> The toner cartridge according to any one of <1> to <3>, wherein the space is so provided in the engaging member as to surround the surface of the seal member on which the edge of the opening is frictionally slid, a circumferential edge of the seal member at a side where the non-contact portion is provided, and the non-contact portion of the seal member.

<5> The toner cartridge according to any one of <1> to <4>, wherein an adhesive member is provided, and the adhesive member is configured to adhere the seal member to the seal member installation surface.

<6> The toner cartridge according to <5>, wherein a shape retaining member configured to retain a shape of the seal member is provided between the seal member and the adhesive member.

<7> The toner cartridge according to any one of <1> to <6>, wherein the engaging member includes a protrusion, and a U-shaped slit provided to a wall of the engaging member adjacent to the protrusion so as to surround the protrusion.

<8> The toner cartridge according to <7>, wherein a convex or concave portion is provided at a bottom part of the protrusion and the convex or concave portion is configured to allow the protrusion to be held from outside of the engaging member.

<9> The toner cartridge according to any of <7> or <8>, wherein the wall holding the protrusion has a lager width than a width of the protrusion.

According to the present invention, a non-contact portion which is not in contact with the seal member installation surface is formed on the surface of the seal member that faces the seal member installation surface, so that there is a portion where is not in contact with the seal member installation surface on the surface of the seal member in the state where the seal member has been installed to the seal member installation surface. Further, a space is so provided in the engaging member so as to extend from the surface of the seal member on which the edge of the mouth portion is frictionally slid to the non-contact portion. In other words, a space for allowing pinching of the portion of the seal member that is not contact with the seal member installation surface is provided. As a result, when the seal member is removed from the seal member installation surface, it is possible to easily pinch, by a jig or finger, the portion of the seal member where is free from any contact with the seal member installation surface through the space. Since the portion of the seal member that is not in contact with the seal member installation surface can be easily retained in this manner, the seal member is easily removed from the seal member installation surface, and as a result, the time and effort required for removing the seal member from the seal member installation surface can be reduced.

Further, there is no need to disassemble the portion adjacent to the seal member installation surface in the engaging member for easy removal of the seal member from the seal member installation surface and, therefore, there is no need to increase the number of parts for making the engaging member easy to disassemble, thereby suppressing an increase in cost.

As described above, according to the present invention, the seal member can be easily removed from the seal member installation surface without increasing the cost.

BEST MODE FOR CARRYING OUT THE INVENTION

First Embodiment

Figure 1:
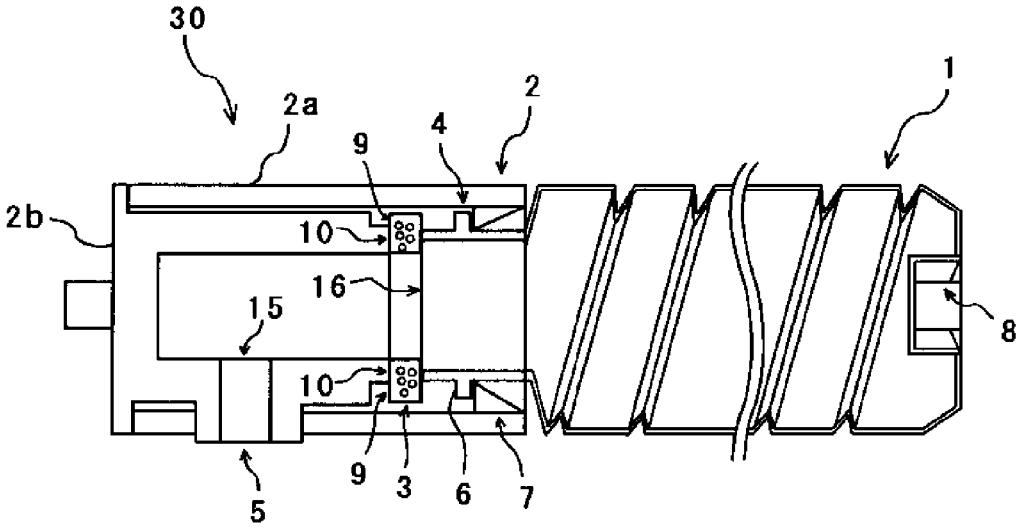
FIG. 1 is a view schematically showing a configuration of a toner container according to a first embodiment of the present invention.

A toner container unit 30 shown in FIG. 1 which is a toner cartridge according to the present embodiment includes a container main body 1 and a supplying section 2. The container main body 1 is made of synthetic resin and includes a bottom portion, a circumferential portion, a shoulder portion, and a mouth portion. A drive force receiving portion 8 to be connected to drive force transmitting means of respective developing sections is formed at the bottom portion which is the attaching-side end portion of the container main body 1 to be attached to a developing unit of an image forming apparatus such as a copying machine, and the supplying section 2 is attached to a mouth portion 16 which is the other side end portion of the container main body 1. A spiral groove is formed in the inner and outer peripheral surfaces of the side peripheral portion of the container main body 1. A container ring 6 protrudes outward from the leading end outer circumferential surface of the mouth portion 16.

The supplying section 2 includes an outer sleeve 2*a* and an inner sleeve 2*b*. The outer sleeve 2*a* is formed into a cylinder and has a toner supply port 5 on the side surface thereof and a plurality of protrusions extending from the inner peripheral surface thereof on a connecting side 4 with the container main body 1. The inner sleeve 2*b* is formed into a cylinder having one end portion sealed by a flange and has a toner supply port 15 on the side surface thereof at a portion corresponding to the toner supply port 5 of the outer sleeve 2*a*. When assembling the supplying section 2, the inner sleeve 2*b* is inserted into the outer sleeve 2*a* so as to achieve engagement between the outer peripheral surface of the inner sleeve 2*b* and inner surface of the outer sleeve 2*a* with each other.

When assembling the toner container unit 30, a suitable jig is used to fix a seal member 3 to a seal member installation portion 9 in the inner sleeve 2*b* of the supplying section 2. The seal member 3 may be fixed to the seal member installation portion 9 using an adhesive or a double-sided adhesive tape, or may be attached to a groove formed in a predetermined position of the supplying section 2.

Figure 2A:
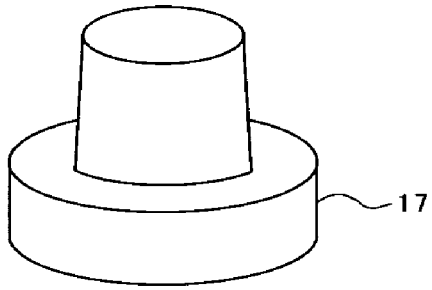
FIG. 2A is an external view of a jig for use in installation of a seal member.
Figure 2B:
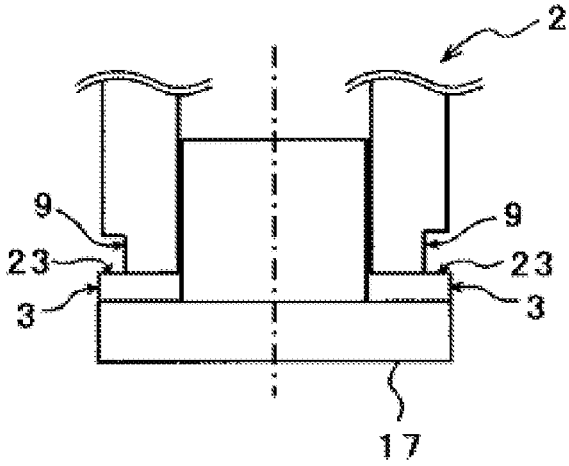
FIG. 2B is a view schematically showing a state where the seal member has been installed to a seal installation portion using the jig.

An example of a jig 17 for use in installation of the seal member 3 in the seal member installation portion 9 is shown in FIGS. 2A and 2B. By using the jig 17 for installing the seal member 3, it is possible to achieve adequate positioning of the seal member 3 relative to the seal member installation portion 9 such that the inner diameter of the seal member 3 and that of the seal member installation portion 9 coincide with each other in the axial direction of the supplying section 2. The coincidence between the inner diameter of the seal member 3 and that of the seal member installation portion 9 prevents the seal member 3 from blocking the migration of the toner to be conveyed from the opening of the container main body 1 to the supplying section 2, thereby achieving satisfactory feeding of the toner from the container main body 1 to the supplying section 2.

After the installation of the seal member 3 to the seal member installation portion 9 in the supplying section 2, the mouth portion 16 of the container main body 1 is inserted into the supplying section 2 through the end portion of the supplying section 2 on the side having the protrusions formed on the outer sleeve 2*a* of the supplying section 2. Then, the container ring 6 formed at the leading end of the mouth portion 16 is latched to the protrusions 7 of the supplying section 2 in a state where the edge of the mouth portion 16 is brought into press-contact with the seal member 3 so as to be slidably moved relative to the same to allow the container main body 1 to be attached to the supplying section 2 in a freely rotatable manner, whereby assembly of the toner container unit 30 is completed.

As the seal member 3, ring-shaped foamed polyurethane (LE 20 made by Inoac Corporation) having a thickness of 2 mm to 5 mm, or a similar material may be used.

Further, the container main body 1 is press-fit to the seal member 3 so as to reduce the thickness of the seal member 3 by 10% to 70%, whereby satisfactory toner sealing performance can be obtained. This desirably prevents toner from leaking from a space between the seal member 3 and edge of the opening of the container main body 1.

When the toner container unit 30 filled with toner is mounted to a developing unit of an image forming apparatus, the toner container unit 30 is inserted into respective developing sections with the drive force receiving portion 8 of the container main body 1 facing the developing unit, the drive force receiving portion 8 is coupled to the drive force transmitting means of the respective developing sections, the toner supply port 5 of the supplying section 2 is positioned, and then the toner container unit 30 is fixed to the respective developing sections.

When a latent image formed on a photoconductor is developed using the developing unit to which the toner container unit 30 has been mounted, a torque output from the drive force transmitting means of the respective developing sections is transmitted to the drive force receiving portion 8 formed in the container main body 1 of the toner container unit 30, causing the container main body 1 to rotate. While the container main body 1 is in rotation, the spiral groove formed in the circumferential portion of the container main body 1 also rotates. As a result, the toner contained in the container main body 1 is sequentially conveyed toward the supplying section 2 and then supplied to the developing sections through the toner supply port 5.

Figure 3:
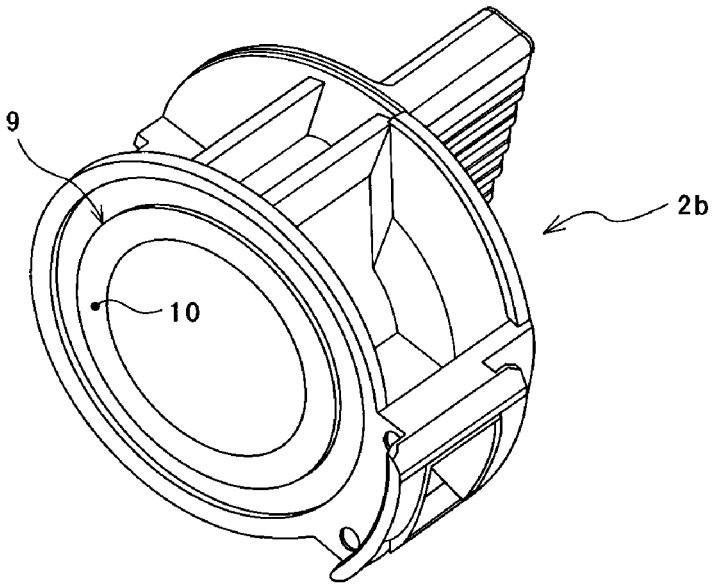
FIG. 3 is a perspective view of an inner sleeve.
Figure 4:
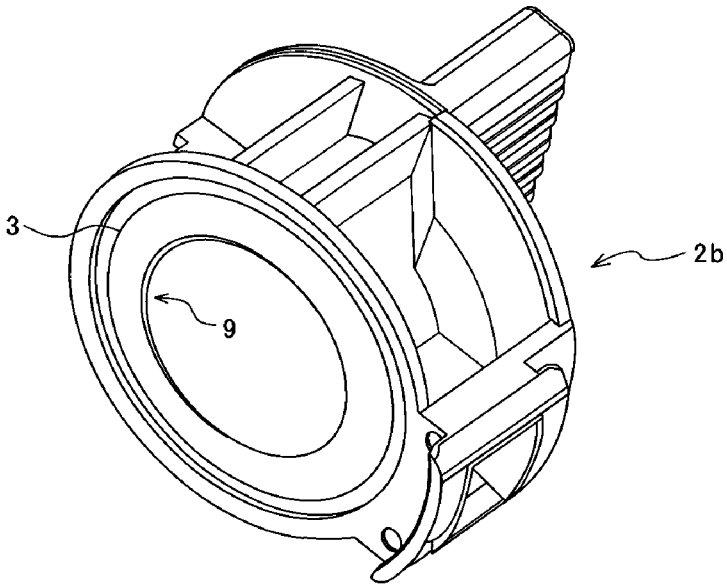
FIG. 4 is a perspective view of the inner sleeve in a state where a seal member has been installed to a seal member installation portion.
Figure 5:
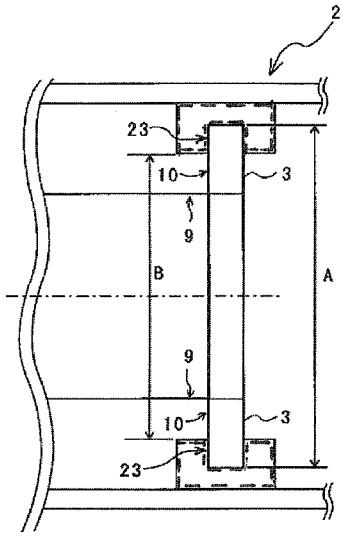
FIG. 5 is an enlarged view of a portion around the seal member installation portion.

Some of characteristic points of the toner container unit 30 according to the present embodiment will next be described. FIG. 3 is a perspective view of the inner sleeve 2*b*. FIG. 4 is a perspective view of the inner sleeve 2*b* in a state where the seal member 3 has been installed to the seal member installation portion 9. An outer diameter A of the seal member 3 used in the present embodiment is larger than outer diameter B of the seal installation portion 9 of the supplying section 2 as shown in FIG. 5. When the seal member 3 having an outer diameter A larger than the outer diameter B of the seal member installation portion 9 is installed to the seal member installation portion 9, a non-contact portion 23 which is a portion where the seal member 3 is not in contact with a seal member installation surface 10 of the seal member installation portion 9 is formed on the outer circumferential side of the ring-shaped seal member 3. Further, as shown in FIGS. 1 and 5, a space (at least the area enclosed by dashed line in FIG. 5) for easy pinching of the seal member 3 is provided around the seal member installation portion 9. Specifically, the space is so provided as to surround the surface of the seal member 3 on which the edge of the mouth portion 16 is frictionally slid, circumferential edge surface of the seal member 3 on the side of which the non-contact portion 23 is provided, and non-contact portion 23 of the seal member 3, so that it is possible to easily set a jig for removing the seal member or finger through the space. As a result, it is possible to easily pinch, by a jig for removing the seal member or finger, a portion of the seal member installation surface side surface of the seal member 3 that is not in contact with the seal member installation surface 10 through the space from the surface of the seal member 3 on which the edge of the mouth portion 16 is frictionally slid and non-contact portion 23 of the seal member 3, thus making it possible to easily remove the seal member 3 from the seal member installation portion 9 without taking time and effort. Note that the difference between the outer diameters of the seal member 3 and seal member installation portion 9 is preferably 1 mm or more for easy pinching of the seal member 3.

Figure 6:
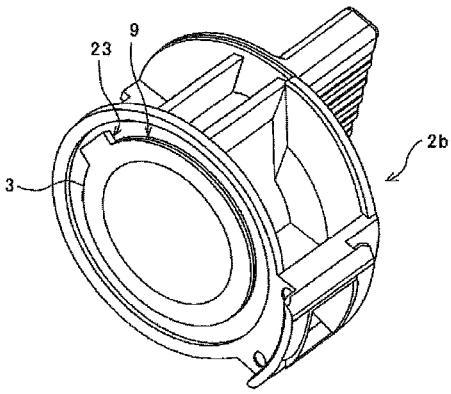
FIG. 6 is a perspective view of the inner sleeve in a state where a seal member having a portion that does not contact the seal member installation surface at a specific position on the outer circumference of the seal member has been installed to the seal installation portion.

Alternatively, as shown in FIG. 6, a portion (non-contact portion) that is not in contact with the seal member installation surface 10 may be provided only at a specific position on the outer circumference of the seal member 3. In this case, only one non-contact portion may be provided as shown in the example of FIG. 6, or a plurality of non-contact portions may be provided.

In the present embodiment, ring-shaped foamed polyurethane having a thickness of 2 mm to 5 mm is used as the seal member 3. However, in the case where the seal member 3 made of an elastic member such as the foamed polyurethane is used, the seal member 3 may be damaged (e.g., torn off) when the seal member 3 is peeled off from the seal member installation portion 9, resulting in extra time and effort to peel off the seal member 3.

Further, there may be a case where only such a seal member 3 is not enough to retain the shape of the seal member 3 itself. When the shape of the seal member 3 cannot be retained, a new seal member 3 to be installed to the seal member installation portion 9 may be stuck to, not the seal member installation surface 10 of the seal member installation portion 9, but the wall of the supplying section 2, resulting in a failure of proper installation of the seal member 3 to the seal member installation portion 9.

Figure 7:
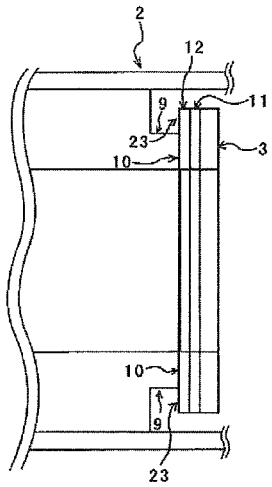
FIG. 7 is a view schematically showing a structure of the seal member.

In view of the above, in the present embodiment, a PET film 11 is provided to the seal member 3 as a shape retaining member for retaining the shape of the seal member 3. A structure of the seal member 3 according to the present embodiment is shown in FIG. 7. As described above, a ring-shaped foamed polyurethane (LE 20 made by Inoac Corporation) having a thickness of 2 mm to 5 mm is used as the seal member 3. A ring-shaped PET film 11 with adhesive having a thickness of 0.02 mm to 0.5 mm is stuck to the one surface of the seal member 3, and a double-sided adhesive tape 12 (No 5000NS made by Nitto Denko Corporation) is attached to the surface of the PET film 11 on the side to which the seal member 3 is not stuck. Note that adhesive may be used in place of the double-sided adhesive tape 12. As a matter of course, when the adhesion of the adhesive is too high, it becomes difficult to peel off the PET film 11 from the seal member installation portion 9, so that it is preferable to select appropriate adhesive with this in mind.

By providing the PET film 11 to the seal member 3 as described above, it is possible to prevent the seal member 3 from being damaged (e.g., torn off) when the seal member 3 is peeled off from the seal member installation portion 9. Further, by providing the PET film 11, the shape of the seal member 3 can be retained. Thus, when the seal member 3 is installed to the seal member installation portion 9 at the time of replacement or the like, it is possible to prevent the seal member 3 from being stuck to a portion other than the seal member installation surface 10 of the seal member installation portion 9. This increases workability when the seal member 3 is installed, thereby achieving proper installation of the seal member 3 to the seal member installation portion 9.

A member used for retaining the shape of the seal member 3 is not limited to the PET film 11 but any member may be used as long as it has rigidity and can retain the shape of the seal member 3.

Figure 8:
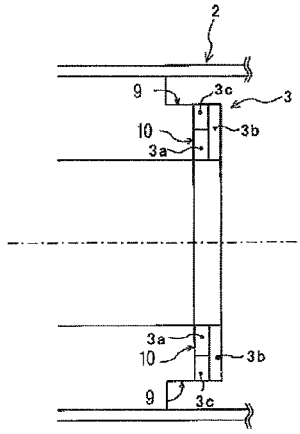
FIG. 8 is a view schematically showing a structure of the seal member constituted by a soft layer and hard layer and a state where a concave has been formed.

Further, as shown in FIG. 8, the seal member 3 is constituted by a soft layer 3*a* (e.g., foamed polyurethane) and a hard layer 3*b* (material having a higher hardness and a higher rigidity than the foamed polyurethane), and a concave 3*c* is provided. With this configuration, it is possible to pinch the hard layer 3*b* of the seal member 3 utilizing the concave 3*c*, thereby preventing the seal member 3 from being torn off when the seal member 3 is removed from the seal member installation portion 9. Further, the existence of the hard layer 3*b* makes it possible to retain the shape of the seal member 3, thereby preventing the seal member 3 from being stuck to, not the seal member installation surface 10, but the wall of the supplying section 2, when the seal member 3 is installed to the seal member installation portion 9.

As shown in FIG. 8, by providing the concave 3*c*, even when the seal member installation portion 9 and seal member 3 have the same outer diameter, it is possible to form a portion that is not in contact with the seal member installation surface 10 on the surface of the seal member 3. As a result, it is possible to set a jig for removing the seal member or finger through the concave 3*c* to thereby easily pinch the seal member 3.

When the seal member 3 is removed from the seal member installation portion 9, it is necessary to release an engagement between the container main body 1 and supplying section 2 for detachment of the supplying section 2 from the container main body 1. When the engagement between the protrusions 7 of the supplying section 2 and container ring 6 of the container main body 1 for removal of the container main body 1 is released from the supplying section 2 by force, the container main body 1 or supplying section 2 may be deformed or damaged.

Figure 9A:
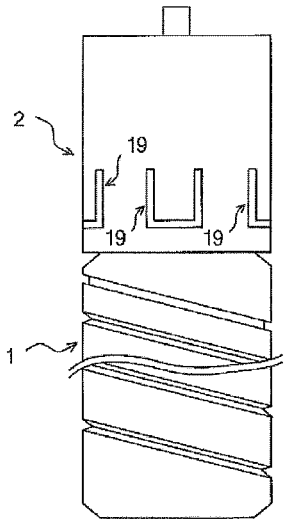
FIG. 9A is an external view of the toner container in which the wall of the supplying section adjacent to the protrusion is supported at only one end in the toner container axial direction.
Figure 9B:
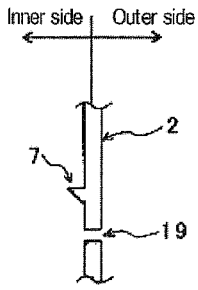
FIG. 9B is a cross-sectional view showing a portion adjacent to the protrusion in the supplying section.

In view of this, in the present embodiment, slits 19 are formed by cutting out in a U-like shape the wall of the supplying section 2 adjacent to the protrusions 7 so as to surround the respective protrusions 7 as shown in FIGS. 9A and 9B. That is, the wall of the supplying section 2 adjacent to the protrusions 7 is supported at only one end in the toner container axial direction, so that the wall of the supplying section 2 adjacent to the protrusions 7 can be elastically deformed with the one end in the toner container axial direction working as a supporting point. Thus, by elastically deforming the wall of the supplying section 2 adjacent to the protrusions 7, it is possible to easily release the engagement between the protrusions 7 and container ring 6, without forcibly releasing the engagement between them. As a result, it is possible to prevent the container main body 1 or supplying section 2 from being deformed or damaged at the time of disassembly.

Figure 10:
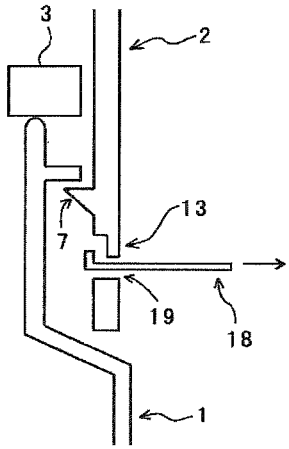
FIG. 10 is a cross-sectional view showing a portion adjacent to the protrusion in the supplying section in the case where a convex lib is formed on the bottom portion of the protrusion.

Further, in the present embodiment, a convex lib 13 is formed on the bottom portion of each protrusion 7 as shown in FIG. 10. When a jig 18 is used to release the engagement between the container ring 6 of the container main body 1 and protrusions 7 of the supplying section 2 as shown in FIG. 10, the jig 18 can be hooked onto and hold the convex lib 13 on the bottom portion of each protrusion 7 from outside thereof. Thus, it is possible to easily release the engagement between the container ring 6 and protrusions 7 by using the jig 18. This increases ease of disassembly between the container main body 1 and supplying section 2, thereby reducing time and effort required for the disassembly work.

In the case where polystyrene is used as a material of the supplying section 2, the dimension of the convex lib 13 is set to 2 mm or more in width, 2 mm or more in height, and 1 mm or more in thickness so that a satisfactory mechanical strength can be obtained. Such a dimension is preferable to the convex lib 13 also in terms of reuse of the supplying section 2.

Figure 11:
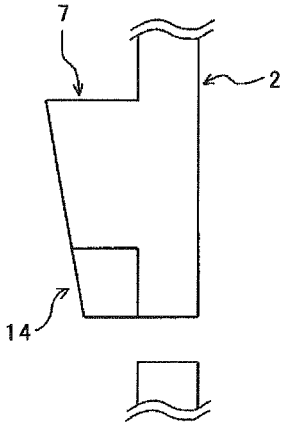
FIG. 11 is a cross-sectional view showing a portion adjacent to the protrusion in the supplying section in the case where a concave is formed on the bottom portion of the protrusion.

In place of the convex lib 13, a concave 14 concaved from the bottom portion of each protrusion 7 toward the upper portion may be formed as shown in FIG. 11. When a jig is used to release the engagement between the container ring 6 of the container main body 1 and protrusions 7 of the supplying section 2, the jig can be hooked onto and hold the concave 14 provided in each protrusion 7 from outside thereof. Thus, as in the case where the convex lib 13 is formed on the bottom portion of each protrusion 7, it is possible to easily release the engagement between the container ring 6 and protrusions 7 by using the jig. This increases ease of disassembly between the container main body 1 and supplying section 2, thereby reducing time and effort required for the disassembly work.

Figure 12:
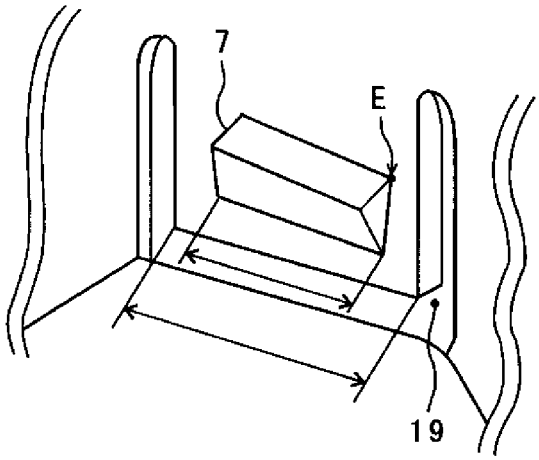
FIG. 12 is a view schematically showing a structure in which the width of a wall for holding the protrusion is made larger than the width of the protrusion.
Figure 13:
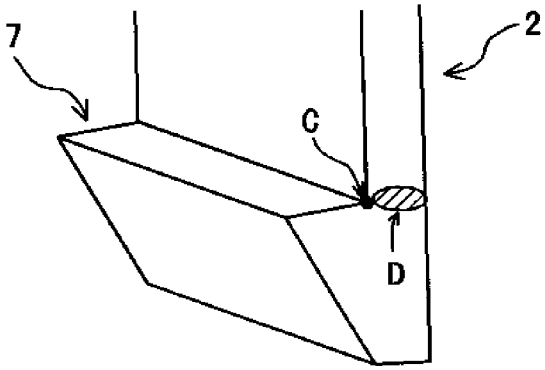
FIG. 13 is a view showing a structure in which the width of a wall for holding the protrusion is made equal to the width of the protrusion.

Further, in the present embodiment, the width of a wall for holding each protrusion 7 is made larger than the width of the protrusion 7 as shown in FIG. 12. This is because that when the width of a wall for holding each protrusion 7 is made equal to the width of the protrusion 7 as shown in FIG. 13, a stress concentrates on point C in the drawing at the time of the engagement between the container ring 6 and protrusions 7 of the supplying section 2, which may cause a crack to form in area D. The presence of a crack may prevent proper engagement between the container ring 6 and protrusions 7 or may cause the holding wall to be damaged and therefore cause the protrusion to come off, thus disabling reuse of the supplying section 2.

In view of this, as shown in FIG. 12, the width of a wall for holding each protrusion 7 is made larger than the width of the protrusion 7. Thus, even if a stress concentrates on point E, the stress is dispersed in the wall side. This prevents the occurrence of a crack to thereby prevent the holding wall from being damaged. As a result, the abovementioned problem in which the container ring 6 and protrusions 7 cannot be properly engaged or the holding wall is damaged to cause the protrusion 7 to come off can be eliminated, thus enabling reuse of the supplying section 2.

Note that in the case where polystyrene is used as a material of the supplying section 2, it is preferable that a ratio (protrusion width: wall width) between the width of each protrusion 7 and width of the wall for holding the protrusion 7 is set to 1:1.1 or more.

Second Embodiment

A configuration of the toner container unit 30 according to the present embodiment is substantially the same as the configuration of the toner container unit 30 according to the first embodiment, and hence, the description will be made of only a characteristic point.

Figure 14:
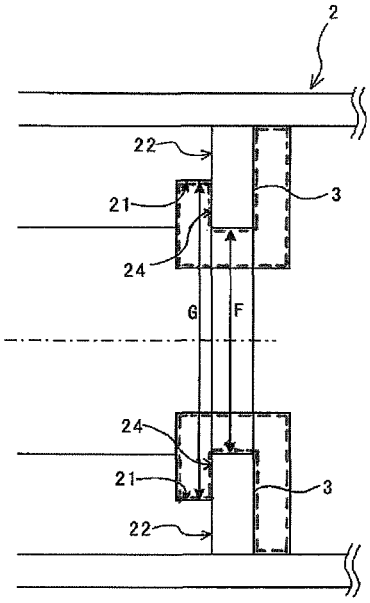
FIG. 14 is an enlarged view of a portion around the seal member installation portion of the toner container according to a second embodiment.

In the present embodiment, as shown in FIG. 14, an inner diameter F of the seal member 3 is made smaller than an inner diameter G of a seal member installation portion 21. When the inner diameter F of the seal member 3 is made smaller than the inner diameter G of the seal member installation portion 21, a non-contact portion 24 which is a portion where the seal member 3 is not in contact with a seal member installation surface 22 of the seal member installation portion 21 is formed on the inner circumferential side of the ring-shaped seal member 3. Further, as shown in FIG. 14, a space (at least the area enclosed by dashed line in FIG. 14) for easy pinching of the seal member 3 is provided around the seal member installation portion 21. Specifically, the space is so provided as to surround the surface of the seal member 3 on which the edge of the mouth portion 16 is frictionally slid, inner circumferential edge which is the circumferential edge of the seal member 3 at the side where the non-contact portion 24 is provided, and non-contact portion 24 of the seal member 3, so that it is possible to easily set a jig for removing the seal member or finger through the space. As a result, it is possible to easily pinch, by a jig for removing the seal member or finger, the seal member 3 through the space from the surface of the seal member 3 on which the edge of the mouth portion 16 is frictionally slid and non-contact portion of the seal member 3, thus making it possible to easily remove the seal member 3 from the seal member installation surface 22 without taking time and effort. Note that the difference between the inner diameters of the seal member 3 and seal member installation portion 21 is preferably 1 mm or more for easy pinching of the seal member 3 by a jig or the like.

As described above, according to the first and second embodiments described above, there is provided the toner container unit 30, i.e. the toner cartridge, containing the container main body 1 which is a toner container for containing a toner therein and the supplying section 2 which is an engaging member. The supplying section 2 is engaged with the container main body 1 so as to cover the mouth portion 16 which is an opening formed in the container main body 1 and is, at the same time, rotatably supported by the container main body 1 while the seal member 3 which is a ring-shaped seal member installed to the seal member installation surface 10, 22 provided in the supplying section 2 itself is frictionally slid on the edge of the mouth portion 16 of the container main body 1. With this configuration, the toner contained in the container main body 1 is conveyed, by the rotation of the container main body 1, into the supplying section 2 through the mouth portion 16, and is then discharged outside the supplying section 2. In the supplying section 2, the non-contact portion 23, 24 that is not in contact with the seal member installation surface 10, 22 is formed on the surface of the seal member 3 which faces the seal member installation surface 10, 22 so as to provide a space extending from the surface of the seal member 3 on which the edge of the mouth portion 16 is frictionally slid to the non-contact portion 23, 24. Since the non-contact portion 23, 24 that is not in contact with the seal member installation surface 10, 22 is formed on the surface of the seal member 3 which faces the seal member installation surface 10, 22, there exists a portion that is not contact with the seal member installation surface 10, 22 on the surface of the seal member 3 in a state where the seal member 3 has been installed to the seal member installation surface 10, 22. Further, the supplying section 2 has a space extending from the surface of the seal member 3 on which the edge of the mouth portion 16 is frictionally slid to the non-contact portion 23, 24. Thus, it is possible to pinch the seal member 3 through the space from the surface of the seal member 3 on which the edge of the mouth portion 16 is frictionally slid and non-contact portion 23, 24 of the seal member 3, thus making it possible to easily remove the seal member 3 from the seal member installation surface 10, 22 of the seal member installation portion 9, 21, which reduces time and effort required for removing the seal member 3 from the seal member installation surface 10, 22. Further, there is no need to disassemble the portion adjacent to the seal member installation surface in the supplying section 2 and, therefore, there is no need to increase the number of parts for making the supplying section 2 easy to disassemble, thereby suppressing an increase in cost. As a result, a configuration is obtained in which the seal member 3 can be easily removed from the seal member installation surface 10, 22 without increasing the cost.

Further, according to the first embodiment, the non-contact portion 23 is formed on the outer circumferential side of the ring-shaped seal member 3, so that it is possible to prevent the size of the opening of the mouth portion 16 of the container main body 1 from being reduced.

Further, according to the second embodiment, the non-contact portion 24 is formed on the inner circumferential side of the ring-shaped seal member 3, so that it is possible to easily install the seal member 3 to the seal member installation surface 22 by inserting the seal member 3 with its outer circumferential edge surface along the side wall of the supply section 2.

Further, according to the first and second embodiments, the space is so provided in the supplying section 2 as to surround the surface of the seal member 3 on which the edge of the mouth portion 16 is frictionally slid, circumferential edge of the seal member 3 at the side where the non-contact portion is provided, and non-contact portion of the seal member 3, so that it is possible to easily set a jig for removing the seal member or the like through the space. As a result, it is possible to easily pinch the seal member 3 by a jig or the like, thus making it possible to easily remove the seal member 3 from the seal member installation portion 9, 21 without taking time and effort.

Further, according to the first and second embodiments, an adhesive member is provided to adhere the seal member 3 to the seal member installation surface 10, 22. This prevents the seal member 3 from being displaced from the proper position when the container main body 1 is rotated and frictionally slid on the seal member 3, thereby ensuring sealing performance of the seal member 3.

Further, according to the first and second embodiment, since the PET film 11 which is a shape retaining member for retaining the shape of the seal member 3 is provided between the seal member 3 and the adhesive member, the shape of the seal member 3 can be retained. Thus, when the seal member 3 is installed at the time of replacement or the like, it is possible to prevent the seal member 3 from being stuck to a portion other than the seal member installation surface 10, 22 of the seal member installation portion 9, 21 or from being damaged.

Further, according to the first and second embodiments, the wall adjacent to the protrusions 7 has U-shaped slits in such manner as to surround the respective protrusions 7. That is, the wall of the supplying section 2 adjacent to the protrusions 7 is supported at only one end in the toner container axial direction, so that the wall of the supplying section 2 adjacent to the protrusions 7 can be elastically deformed with the one end in the toner container axial direction working as a supporting point. Thus, by elastically deforming the wall of the supplying section 2 adjacent to the protrusions 7, it is possible to easily release the engagement between the protrusions 7 and container ring 6 without forcibly releasing the engagement. As a result, it is possible to prevent the container main body 1 or supplying section 2 from being deformed or damaged at the time of disassembly.

Further, according to the first and second embodiments, the convex lib 13 or concave 14 for enabling each protrusion 7 to be held from outside of the supplying section 2 is formed on the bottom portion of the protrusion 7. When a jig is used to release the engagement between the container ring 6 and protrusions 7, the jig can be hooked onto and can hold the convex lib 13 or concave 14 formed on the bottom portion of each protrusion 7 from outside thereof. Thus, it is possible to easily release the engagement between the container ring 6 and protrusions 7 by using the jig. This increases ease of disassembly between the container main body 1 and supplying section 2, thereby reducing time and effort required for the disassembly work.

Further, according to the first and second embodiments, the width of the wall for holding each protrusion 7 is made larger than the width of the protrusion 7. Thus, a stress applied at the time of assembly or disassembly is dispersed in the wall side. This increases the mechanical strength to prevent occurrence of a crack in the wall or damage of the wall.

The invention claimed is:

1. A toner cartridge comprising:

a toner container formed with an opening, and configured to contain a toner therein; and an engaging member comprising a discharge opening and a ring-shaped seal member disposed on a seal member installation surface provided in the engaging member, the engaging member being engaged with the toner container so as to cover the opening of the toner container and rotatably mounted to the toner container while an edge of the opening of the toner container is frictionally slid on a surface of the ring-shaped seal member, wherein the toner container is configured to convey the toner contained therein into the engaging member through the opening and discharge the toner from the engaging member, as the toner container is rotated, and wherein the seal member includes a non-contact portion arranged at a surface thereof which faces the seal member installation surface, the non-contact portion being free from any contact with the seal member installation surface, so that the engaging member includes a space extending from the surface of the seal member on which the edge of the opening is frictionally slid to the non-contact portion in the engaging member, wherein an adhesive member is provided, and the adhesive member is configured to bond the seal member to the seal member installation surface, and wherein a shape retaining member configured to retain a shape of the seal member is provided between the seal member and the adhesive member.

2. The toner cartridge according to claim 1, wherein the non-contact portion exists on an outer circumferential side of the ring-shaped seal member.

3. The toner cartridge according to claim 1, wherein the non-contact portion exists on an inner circumferential side of the ring-shaped seal member.

4. The toner cartridge according to claim 1, wherein the space is disposed to surround (i) the surface of the seal member on which the edge of the opening is frictionally slid, (ii) a circumferential edge of the seal member at a side where the non-contact portion is provided, and (iiii) the non-contact portion of the seal member.

5. The toner cartridge according to claim 1, wherein the engaging member includes a protrusion, and a U-shaped slit provided to a wall of the engaging member adjacent to the protrusion so as to surround the protrusion.

6. The toner cartridge according to claim 5, wherein a convex or concave portion is provided at a bottom part of the protrusion and the convex or concave portion is configured to allow the protrusion to be held from outside of the engaging member.

7. The toner cartridge according to claim 5, wherein the wall holding the protrusion has a larger width than a width of the protrusion.

* * * * *